United States Patent [19]

Chari et al.

[11] Patent Number: 5,008,179

[45] Date of Patent: Apr. 16, 1991

[54] INCREASED ACTIVITY PRECIPITATED PHOTOGRAPHIC MATERIALS

[75] Inventors: Krishnan Chari, Rochester; Wayne A. Bowman, Walworth; Brian Thomas, Fairport, all of N.Y.

[73] Assignee: Eastman Kodak Company, Rochester, N.Y.

[21] Appl. No.: 440,160

[22] Filed: Nov. 22, 1989

[51] Int. Cl.[5] ..... G03C 7/32; G03C 7/388

[52] U.S. Cl. ..... 430/546; 430/377; 430/545; 430/627; 430/631; 430/935

[58] Field of Search ..... 430/546, 545, 935, 631, 430/627, 377

[56] References Cited

U.S. PATENT DOCUMENTS

| | | | |
|---|---|---|---|
| 2,698,794 | 1/1955 | Godowsky | 95/2 |
| 2,787,544 | 4/1957 | Godowsky et al. | 96/97 |
| 2,801,170 | 7/1957 | Vittum et al. | 96/97 |
| 2,801,171 | 7/1957 | Fierke et al. | 96/97 |
| 2,870,012 | 1/1959 | Godowsky et al. | 96/97 |
| 2,949,360 | 8/1960 | Julian | 96/97 |
| 3,619,195 | 11/1971 | Van Campen | 96/100 |
| 4,140,530 | 2/1979 | Trunley et al. | 96/67 |
| 4,199,363 | 4/1980 | Chen | 430/512 |
| 4,368,258 | 1/1983 | Fujiwhara et al. | 430/493 |
| 4,419,441 | 12/1983 | Nittel et al. | 430/377 |
| 4,624,903 | 11/1986 | Simons | 430/14 |
| 4,716,099 | 12/1987 | Simons | 430/493 |
| 4,766,061 | 8/1988 | Simons | 430/546 |

FOREIGN PATENT DOCUMENTS 1603884 5/1978 United Kingdom .

*Primary Examiner*—Charles L. Bowers, Jr.
*Assistant Examiner*—Janis L. Dote
*Attorney, Agent, or Firm*—Paul A. Leipold

[57] ABSTRACT

The invention is accomplished by providing an aqueous dispersion of a photographic coupler by precipitation from a solvent solution by solvent and/or pH shift. A second aqueous dispersion of an activating permanent solvent for the photographic coupler is also provided. The dispersion of activating permanent solvent and photographic coupler are combined to form a combined dispersion which is mixed with a gelatin dispersion of silver halide particles to form a photographic emulsion suitable for casting as a photographic element. In a preferred method of the invention, the activating solvent is incorporated into a dispersion of latex particles prior to being combined with the dispersion of photographic coupler.

31 Claims, 5 Drawing Sheets

INCREASED ACTIVITY PRECIPITATED PHOTOGRAPHIC MATERIALS

FIELD OF THE INVENTION

The present invention concerns a method for forming stable finely dispersed particles of photographic components and incorporating such dispersions in photographic systems. It particularly relates to the preparation of stable dispersions of photographic coupler materials.

PRIOR ART

The conventional method for incorporating hydrophobic couplers is described in U.S. Pat. No. 2,322,027 by Jelly and Vittum. The coupler is dissolved in a high boiling water immiscible solvent, mixed with aqueous gelatin, and dispersed using a colloid mill or homogenizer. The dispersion is then chill set and stored under refrigeration.

Frequently, the combination of coupler and solvent has to be heated to a high temperature in order to dissolve the coupler. In some instances the coupler may crystallize subsequently upon chill setting and storage of the dispersion. In designing formulations, considerable effort has to be made to select a coupler solvent so that the coupler does not crystallize. The process also suffers from the disadvantage that a large amount of energy has to be expended to generate the high shearing forces needed in milling or homogenization.

Alternative methods for delivering hydrophobic materials, such as color couplers to photographic compositions, are known in the art. U.S. Pat. No. 4,199,363 by Chen describes latex loading as a method. The coupler is loaded into a latex polymer by mixing a solution of the coupler in a low boiling water miscible organic solvent with an aqueous suspension of the latex. The solvent is then removed by evaporation or washing, and the latex suspension is mixed with aqueous gelatin. It has been observed that coagulation of the latex may occur while loading the coupler into the latex or subsequently while mixing the loaded latex with gelatin.

U.S. Pat. No. 2,801,170 —Vittum et al discloses preparing separate dispersions of a coupler and a high boiling point solvent and mixing the two dispersions with a silver halide emulsion.

U.S. Pat. No. 2,787,544 —Godowsky et al discloses a method of making mixed packet photographic systems. A dispersion of high boiling point solvent is mixed with a dispersion of coupler.

While both these processes help prevent crystallization of the coupler by keeping the solvent and the coupler separate until just prior to coating, the separate dispersions are prepared by milling or homogenization and, therefore, require the use of large amounts of energy to achieve the necessary size reduction. There remains a need for processes that will produce stable fine particle dispersions of photographic components without the use of energy intensive mechanical operations.

The art of precipitation of hydrophobic coupler for photographic systems, starting from a solution state, to a stable fine particle colloidal dispersion is known. This is generally achieved by dissolving the coupler in a water-miscible solvent aided by addition of base to ionize the coupler, addition of a surfactant with subsequent precipitation of the couplers by lowering the pH, or by shift in concentration of the two or more miscible solvents, such that the coupler is no longer soluble in the continuous phase and precipitates as a fine colloidal dispersion.

In United Kingdom Pat. No. 1,193,349 —Townsley et al discloses a process whereby a color coupler is dissolved in a mixture of water-miscible organic solvent and aqueous alkali. The solution of coupler is then homogeneously mixed with an aqueous acid medium including a protective colloid. Thus was formed a dispersion of precipitated color coupler by shift of pH, and this dispersion of color coupler, when mixed with a dispersion of an aqueous silver halide emulsion and coated on a support, was incorporated into a photographic element.

In an article in *Research Disclosure* 16468, Dec. 1977, pages 75–80 entitled "Process for Preparing Stable Aqueous Dispersions of Certain Hydrophobic Materials" by W.J. Priest, published by Industrial Opportunities Ltd., The Old Harbormaster's, 8 North Street Emsworth, Hants P 010 7DD U.K., a method of forming stable aqueous dispersions of hydrophobic photographic material was disclosed. The process of Priest involves the formation of an alkaline aqueous solution of an alkali soluble color-forming coupler compound in the presence of a colloid stabilizer or polymeric latex. The alkali solution is then made more acidic in order to precipitate coupler. The particles of coupler are stabilized against excessive coagulation by adsorption of a colloid stabilizer.

U.S. Pat. No. 2,870,012 —Godowsky et al disclosed formation of a finely divided suspension of a coupler by precipitation caused by solvent shift. Also disclosed is utilization of a surfactant that is a dioctyl ester of sodium sulfosuccinic acid as a wetting or dispersing agent. It is indicated in Godowsky et al that the materials are stable for a long period of time after removal of the solvent.

U.S. Pat. No. 4,388,403—Helling et al discloses the formation of dispersions of polymers that are stable for long periods of time and useful in photographic processes.

In earlier filed U.S. patent application Ser. No. 288,922 of Chari filed Dec. 23, 1988, it was proposed that stable dispersions of couplers be formed by a precipitation process by solvent and/or pH shift from solution in the presence of a nonionic water soluble polymer in combination with anionic surfactant having a sulfate or sulfonate head group and a hydrocarbon chain containing 8 to 20 carbons. While this technique was successful in forming stable dispersions, without the use of mechanical operations such as milling or homogenization, it was found that the dispersed coupler was not always as active as in dispersions formed by the previous milling process described in U.S. Pat. No. 2,322,027 by Jelly and Vittum Therefore, there remains a need for processes that will produce precipitated dispersions of photographic materials, such as couplers, that are photographically active.

THE INVENTION

An object of the invention is to overcome difficulties with the prior processes of forming dispersions of photographic materials.

A further object is to provide precipitated coupler dispersions of improved photographic activity.

Another object of the invention is to provide a method of forming dispersions of photographic coupler materials that are stable during storage without refrigeration.

A further object of the invention is to provide a method of forming photographic materials with improved dye stability.

A further object of the invention is to provide dispersions of photographic coupler materials without the use of mechanical operations, such as milling or homogenization.

These and other objects of the invention are generally accomplished by providing an aqueous dispersion of photographic coupler, providing an aqueous dispersion of activating permanent solvent, combining said dispersion of photographic coupler and said dispersion of permanent solvent to form a combined dispersion, and mixing said combined dispersion with silver halide emulsion. In a preferred method of the invention, the activating solvent is incorporated into a dispersion of latex particles prior to being combined with the dispersion of photographic coupler, and the dispersion of photographic coupler is provided by precipitation from auxiliary solvent solution by pH or solvent shift.

MODES OF PERFORMING THE INVENTION

The invention has numerous advantages over prior processes. The invention allows the formation of stable coupler dispersions that can be kept without refrigeration. The invention provides dispersions formed by pH or solvent shift having photographic activity at least equal to that of the previous milled dispersions of couplers. The invention provides dispersions without the use of mechanical operations, such as milling or homogenization. Further, it has also been found that the invention provides photographic elements of higher dye stability than elements formed by prior milling processes for the same coupler materials. These and other advantages will be apparent from the description below.

Figure 1:
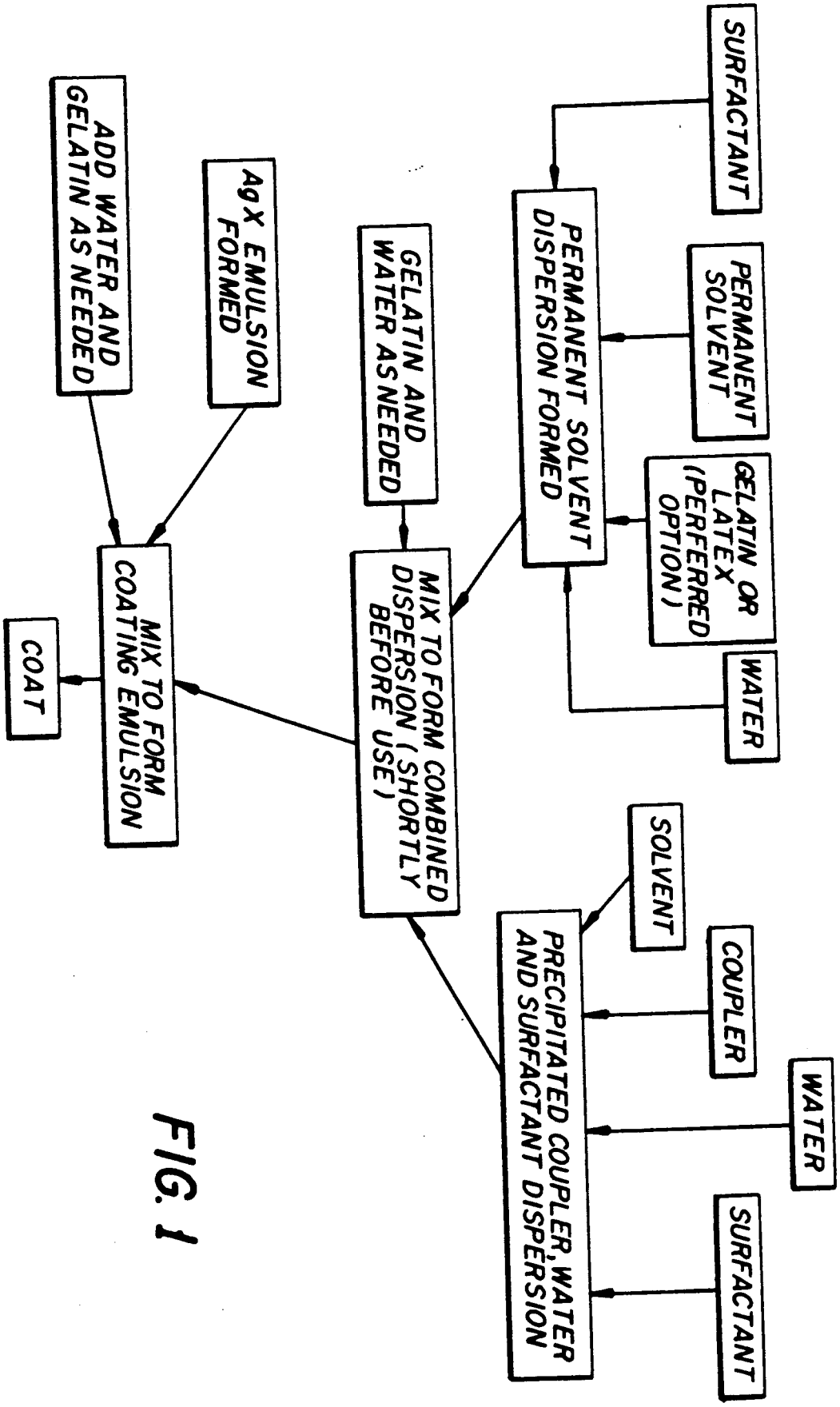
FIG. 1 is a flow sheet illustrating the steps of the invention process.

A flow sheet of the process of the invention is illustrated in FIG. 1. As illustrated there, the invention is generally performed by combining a permanent solvent and water to form a dispersion of the permanent solvent in water. There may also be surfactants and polymers present. In a preferred form, latex is present and combines with the permanent solvent to form the particles of the dispersion with the permanent water immiscible solvent. The permanent water immiscible solvent is a solvent for the coupler.

A second dispersion of coupler, water, and surfactant is prepared by dissolving the coupler in an auxiliary solvent and surfactant, precipitating the coupler by addition of water and/or change of pH to form the dispersion, and then washing to remove the auxiliary solvent. These two dispersions, one containing the permanent water immiscible solvent and the other the coupler particles, are mixed, preferably shortly before use. They are then combined with a silver halide emulsion formed by any conventional means and then, after addition of water and gelatin as needed to form the proper coating emulsion, are coated to form a photographic element. The photographic elements of the invention have been found to be more light stable than photographic materials formed in conventional manner utilizing milling instead of the invention process of formation of couplers in small particles by pH or solvent shift from solutions. As the permanent solvent and coupler do not come into contact until immediately prior to use, difficulties with crystallization of the coupler during storage are eliminated.

The dispersions that contain only the permanent solvent are prepared by mixing the permanent solvent with a low boiling auxiliary solvent such as methanol in the presence of surface active agents and then mixing the composition with an aqueous suspension of polymer latex. The suspension of latex particles with permanent solvent is then washed to remove the auxiliary solvent. It is preferred that the polymer latex is soluble in water at pH 7 or higher.

The dispersions of coupler are generally performed by combining the coupler with a solvent, such as propanol, and heating and stirring until the coupler is dissolved. To the dissolved coupler is added additional water, surfactant, and an acid to lower the pH to form particles. The solvent may have had a base such as sodium hydroxide added to aid in dissolving of the coupler. The dispersion after pH and solvent shift is then washed to remove the solvent. The washed coupler dispersion is storage stable without refrigeration. The separate dispersions of permanent water immiscible solvent and precipitated coupler are preferably mixed shortly prior to use. After the coupler dispersion and permanent solvent dispersion have been mixed together, the combined dispersion is then mixed with a silver halide emulsion and other materials as needed to form photographic film. The earlier filed U.S. Pat. Ser. No. 288,922 filed Dec. 23, 1988, Inventor, Chari, is referred to for detailed disclosure of formation of the preferred coupler dispersions and is incorporated herein by reference.

The latex as suitable for the invention may be any latex that is water immiscible below pH 7 and will combine with the permanent solvents. In this invention, as the polymer advantageously used as the latex, there may be included polymeric compounds, such as vinyl polymers having pendant carboxyl groups or sulfonic acid groups. Alternatively, condensation type polymeric compounds may also be used. Vinyl polymers may include copolymers of monomers having pendant carboxylic groups or sulfonic acid groups, such as methacrylic acid, acrylic acid, and vinyl sulfonic acid with monomers, such as alkyl acrylates or alkyl methacrylates.

Preferred materials have been found to be copolymers of acrylic acid or methacrylic acid, and alkyl acrylate or alkyl methacrylate, as they are insoluble in water at low pH and soluble at high pH.

Most preferred are copolymers containing 15 to 30% by weight of acrylic acid.

The couplers suitable for the invention may be any couplers that may be precipitated by solvent and/or pH shift and whose activity after precipitation has increased by use of a water immisible permanent solvent. Typical of such compounds are yellow, magenta, or cyan dye forming ballasted photographic couplers that do not contain low pKa ionizable groups, such as carboxylic acid or sulfonamides in the ballast portion of the molecule. Preferred couplers are listed below.

Couplers
C-2
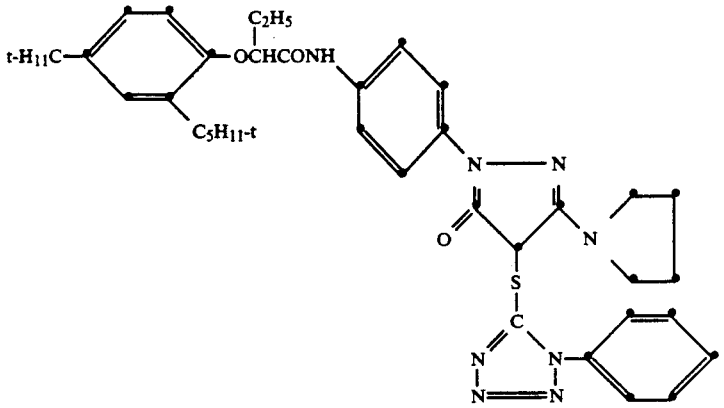
C3
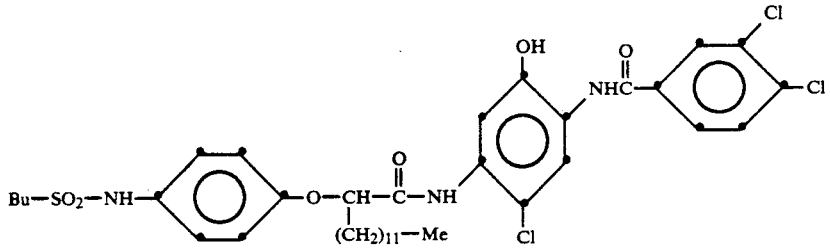
C4
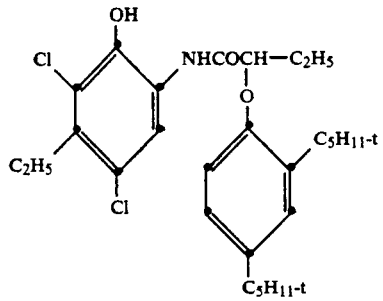
C5
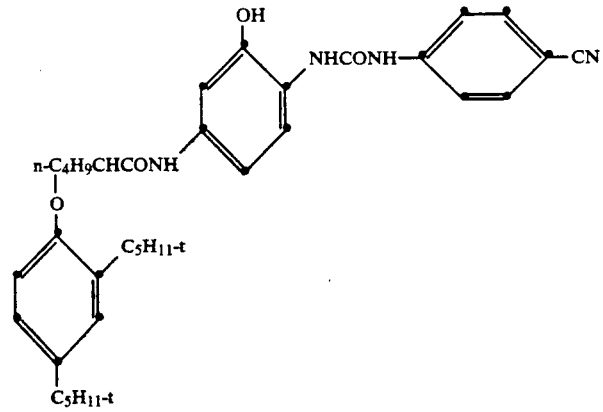
C6
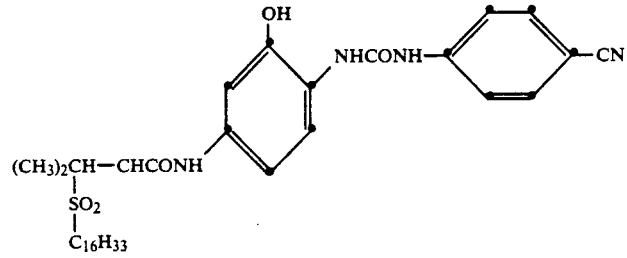

-continued
Couplers
C7
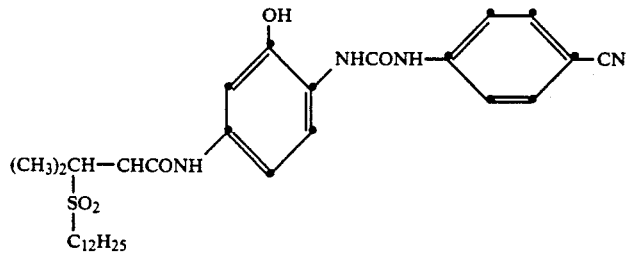
C8
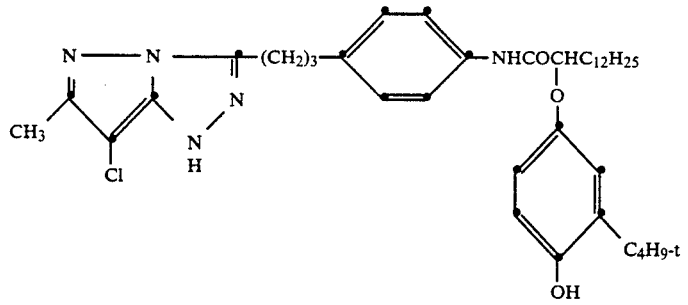
C9
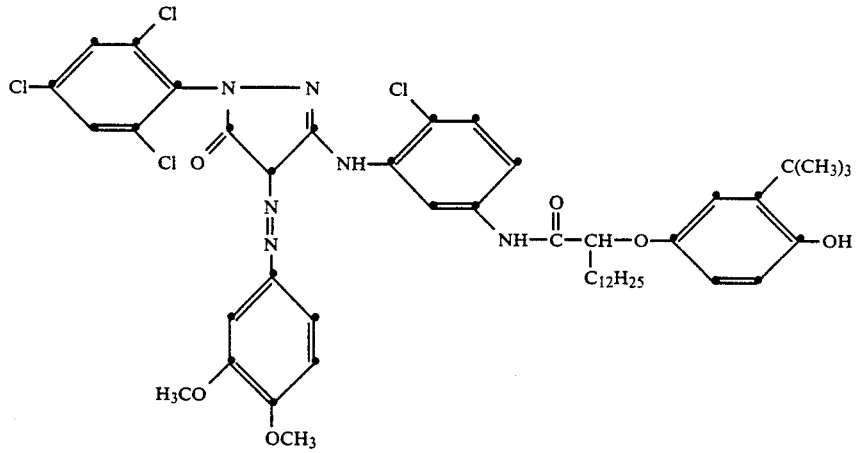
C10
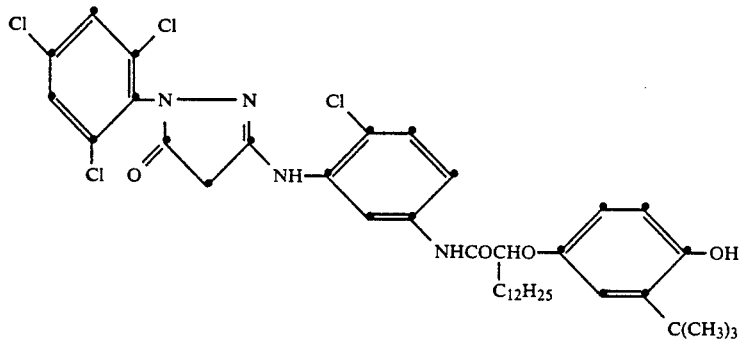

-continued
Couplers
C11
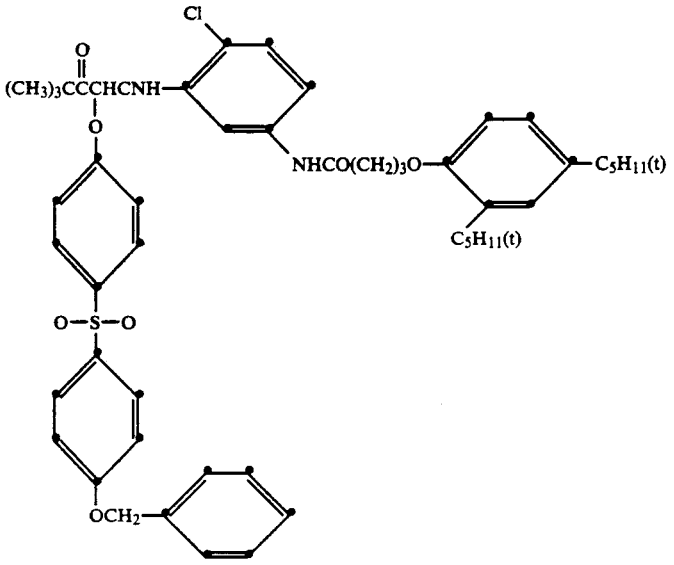
The permanent solvents may be any solvent that is compatible with the couplers and latex utilized, serves to activate the coupler, and is water immiscible. Typical of such permanent solvents are:
| Solvent | Structure |
|---|---|
| S-1 tri-cresyl phosphate | 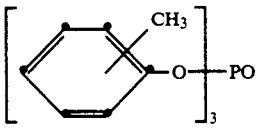 |
| S-2 di-n-butyl phthalate | 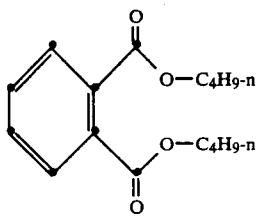 |
| N,N-diethyl lauramide | $CH_3(CH_2)_{10}CON(C_2H_5)_2$ |
| 2,4-di-t-amyl phenol | 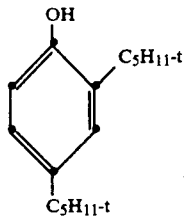 |
| N-n-butyl acetanilide | 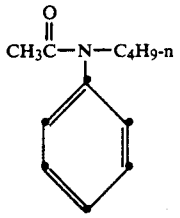 |

-continued
| Solvent | Structure |
|---|---|
| 2,4-di-n-amyl phenol | 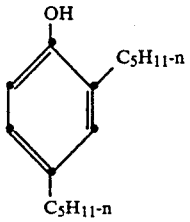 |
| 1,4-cyclohexylene ethylhexanoate) | 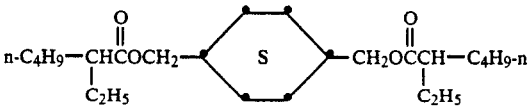 |
| bis(2-ethylhexyl) phthalate | 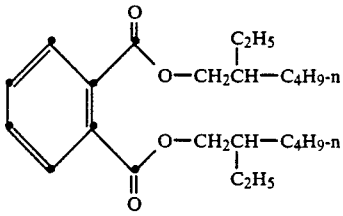 |
| di-n-decyl phthalate (DDP) | 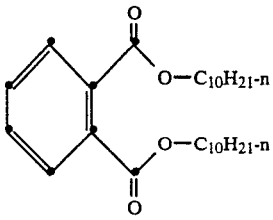 |
| bis(10,11-epoxyundecyl) phthalate | 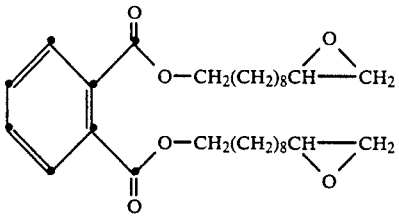 |
| tri-n-hexyl phosphate (THP) | $[CH_3(CH_2)_4CH_2]_3PO$ |
| dimethyl phthalate | 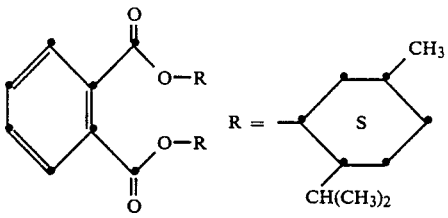 |
| 1-octanol (OCA) | $CH_3(CH_2)_7OH$ |
| 1-undecanol | $CH_3(CH_2)_{10}OH$ |
| tri-cyclohexyl phosphate (TCHP) | 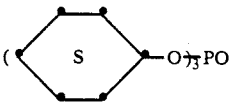 |
| tri-isononyl phosphate (TNP) | $[(CH_3)_3CCH_2CH(CH_3)CH_2CH_2-O]_3PO$ |

-continued

| Solvent | Structure |
|---|---|
| S-3 p-dodecylphenol | 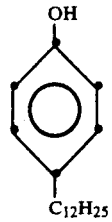 |

Preferred permanent solvents are the tricresyl phosphate, di-n-butyl phthalate, and p-dodecylphenol illustrated above as S-1, S-2, and S-3.

The water miscible auxiliary solvent for dissolving the hydrophobic coupler may be any solvent capable of dissolving the coupler without decomposing the coupler. Suitable solvents include methanol, propanol, isopropyl alcohol, and butyl alcohol.

The surfactants for the invention are any anionic surfactant having a sulfate or sulfonate head group. The head group is the group on the surfactant that extends away from the particle into the water in which the particles disperse. The other portion of the surfactant is a hydrophobic group of 8 to 20 carbons that will lie on the surface of the coupler particle. The sulfate or sulfonate group may be represented as an $SO_3M$ or $OSO_3M$ moiety where M represents a cation. M most commonly is sodium. Typical of surfactants suitable for the invention are those as follows:

$C_{14}H_{29}OSO_3Na$ A-2

$C_{12}H_{25}CONHCH_2CH_2OSO_3Na$ A-3

$C_{12}H_{25}SO_3Na$ A-4

$C_{14}H_{29}SO_3Na$ A-5

$NaO_3S-CH(CH_2COOC_8H_{17})-COOC_8H_{17}$ A-6

A-7

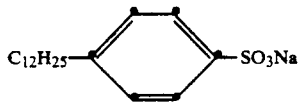

A-8

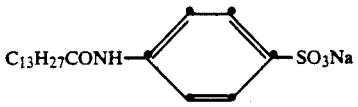

A-9

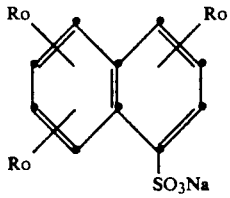

Ro represents $-CH(CH_3)_2$

A-10

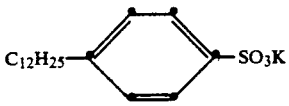

-continued

A-11

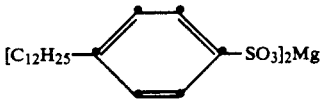

The surfactants below are preferred as they form uniform storage stable dispersions:

A mixture of di-isopropyl and tri-isopropyl naphthalene sodium sulfonate. The ratio of the di-isopropyl to the tri-isopropyl compound is between about 0.25 and about 2.0. A-12

A-13

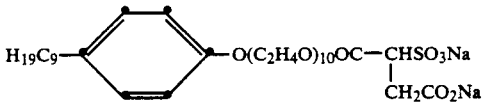

$C_{12}H_{25}OSO_3Na$ A-1

$H_{25}C_{12}O(C_2H_4O)_5OC-CH(CH_2CO_2Na)SO_3Na$ A-14

A-15

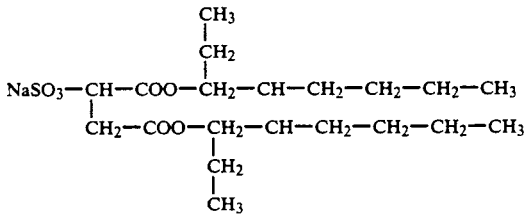

EXAMPLES

EXAMPLE 1

This Example and Example 2 illustrate the influence of permanent solvent on the reactivity of a precipitated dispersion of the DIR coupler C2. The permanent solvent is shown to cause an increase in reactivity.

A precipitated dispersion of C2 was prepared using the following procedure: 4.0 grams of the compound was mixed with 10.0 grams of n-propanol and heated to 40° C. 1.3 grams of a 20% w/w sodium hydroxide solution was then added, and the mixture was stirred until the coupler dissolved completely. A surfactant solution containing 3.75 grams of 30% A-13 in 175 grams of water was then added to the dissolved coupler at room temperature. A 15% w/w solution of acetic acid was added to lower the pH to 6. The dispersion was poured into a dialysis bag and washed with distilled water for four hours. The washed dispersion contained 1.9% w/w of the coupler.

A precipitated dispersion of the image magenta coupler C1 was prepared in the following manner: 9.0 ml of n-propanol was added to 4.3 grams of the coupler, and the mixture was heated to 60° C. with stirring. 6.0 ml of one molar sodium hydroxide solution was added, and the stirring was continued until the coupler dissolved. The solution was allowed to cool to room temperature. Then 2.16 grams of polyvinylpyrrolidone (40,000 mw) was dissolved in 150 ml of a 0.01M aqueous solution of sodium dodecyl sulfate. The surfactant solution was added to the dissolved coupler. A 15% w/w solution of acetic acid was then added to lower the pH to 6 and form the dispersion. The dispersion was poured into a dialysis bag and washed with distilled water for four hours. The washed dispersion contained 2.4% of the coupler C1.

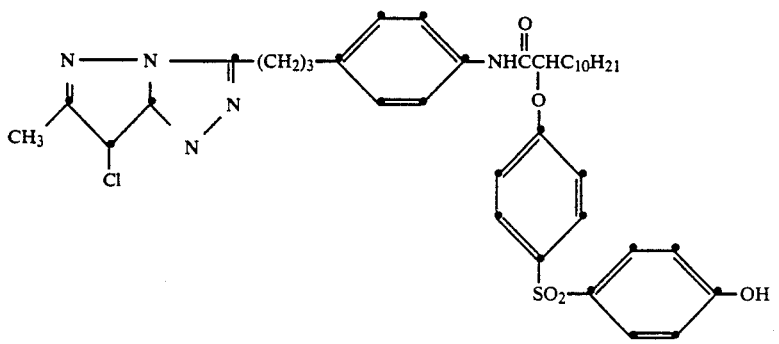

C1

PREPARATION OF THE POLYMER LATEX A

To a one liter 3-necked flask equipped with a stirrer and condenser was added 300 ml of degassed water, 4 ml of a 30% solution of Triton 770 TM, a sodium salt of alkyl aryl polyether sulfate, 1.0 gram/of potassium persulfate, and 0.33 grams of sodium meta bisulfite. The contents were heated to 80° C. under nitrogen, and the contents of a header flask containing 100 ml of degassed water, 4 ml of a 30% solution of Triton TM 770, 75.0 grams of ethylacrylate, 20.0 grams of acrylic acid, and 5.0 grams of 2-acrylamido-2-methyl propane sulfonic acid sodium salt was added over a period of 30 minutes. The contents of the reaction flask were stirred at 80° C. under nitrogen for one hour and cooled to give a white suspension. 300 ml of water was added, and the suspension was concentrated on a rotary evaporator to remove residual monomer. The resulting latex contained 22.85 w/w polymer.

A dispersion of the permanent solvent S-1 was prepared in the following manner: 20 ml of an aqueous suspension of the polymer latex A containing 22.8% w/w polymer was mixed with 10 ml of n-propanol and 20 ml of distilled water. 2 ml of S-1 was mixed with 40 ml of n-propanol and 1 gram of A-15. This was added to the suspension of polymer latex with stirring. The latex suspension was then poured into a dialysis bag and washed with distilled water for one hour. The washed sample contained 1.4% w/w of S-1.

The dispersions were mixed with gelatin and coated on a cellulose acetate support along with a green sensitized iodobromide emulsion at laydowns of 45 mg/ft$^2$ C1, 5 mg/ft$^2$ C2, 30 mg/ft$^2$ S-1, 150 mg/ft$^2$ silver and 250 mg/ft$^2$ gelatin. An overcoat containing hardener was coated above the emulsion layer.

A second control coating containing the same laydown of coupler, emulsion, and gelatin but containing no S-1 was formed as the control.

The samples were exposed to a 2850K tungsten lamp with daylight V and Wratten 99 filters for 0.5 seconds using a 21-step tablet (0-4 chart). Processing was at 100° F. with the standard C41 sequence except that a stop (2 min) and wash (3 min) was used between the development and bleach steps. The composition of the stop solution is given below:

| | |
|---|---|
| Glacial acetic acid | 30.0 ml |
| 50% Sodium hydroxide solution | 0.4 ml |
| Distilled Water | 969.6 ml |

The amount of developed silver as a function of exposure was determined by eliminating the bleach step during processing.

Figure 2:
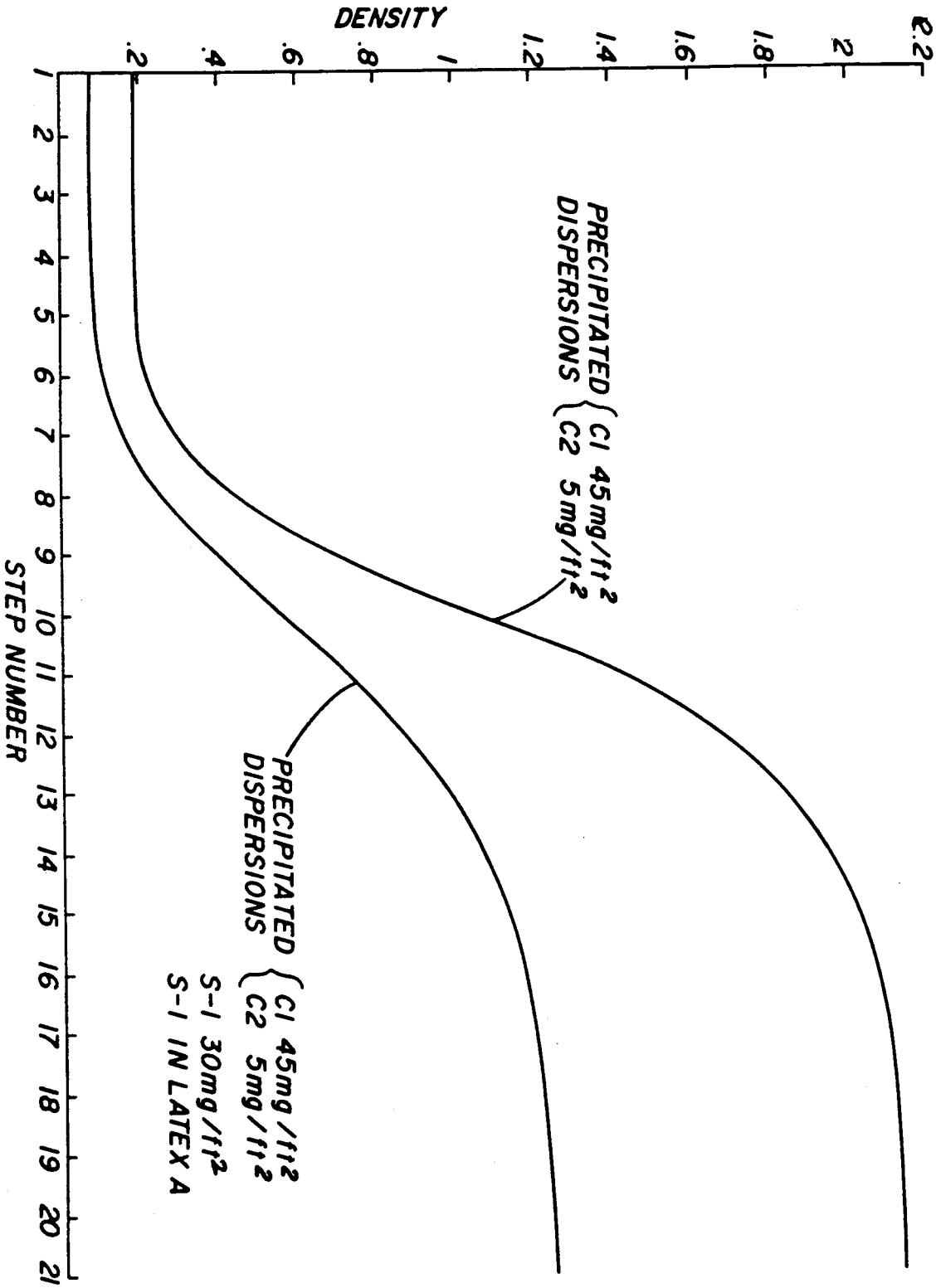
FIGS. 2–7 illustrate sensitometric data of the Examples.
Figure 3:
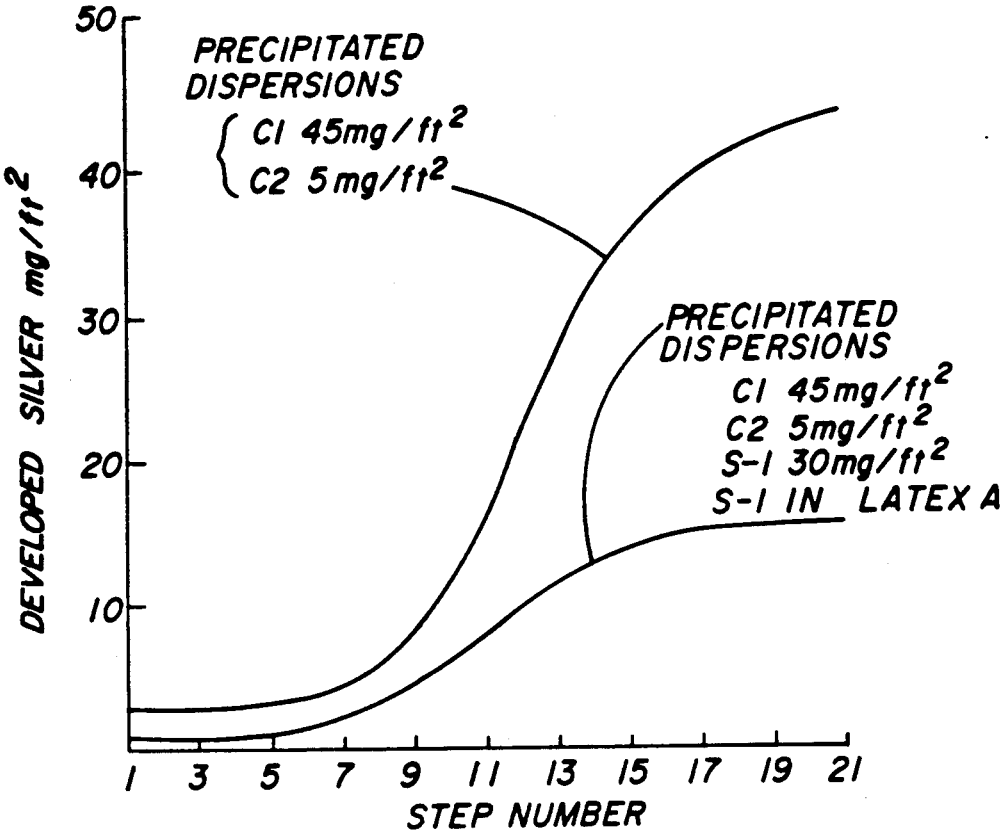

The results are shown in FIG. 2 and FIG. 3.

EXAMPLE 2 (Control)

The procedure of Example 1 is repeated except that the dispersion of S-1 was prepared using a colloid mill instead of using a polymer latex. 80 grams of S-1 was mixed with 40 grams of auxiliary solvent SA-1 and heated to 71° C. A mixture of 218 grams of a 12.5% solution of gelatin, 54 grams of distilled water, and 27.2 grams of a 10% solution of A-12 was treated with 5.5 ml of 2N propionic acid and then added to the heated oil phase with stirring. The composition was passed through a colloid mill for five passes. The dispersion was chilled, noodled, and washed for four hours.

2-(2-butoxyethoxy)ethyl acetate (SA-1)

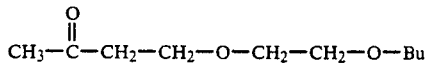

Figure 4:
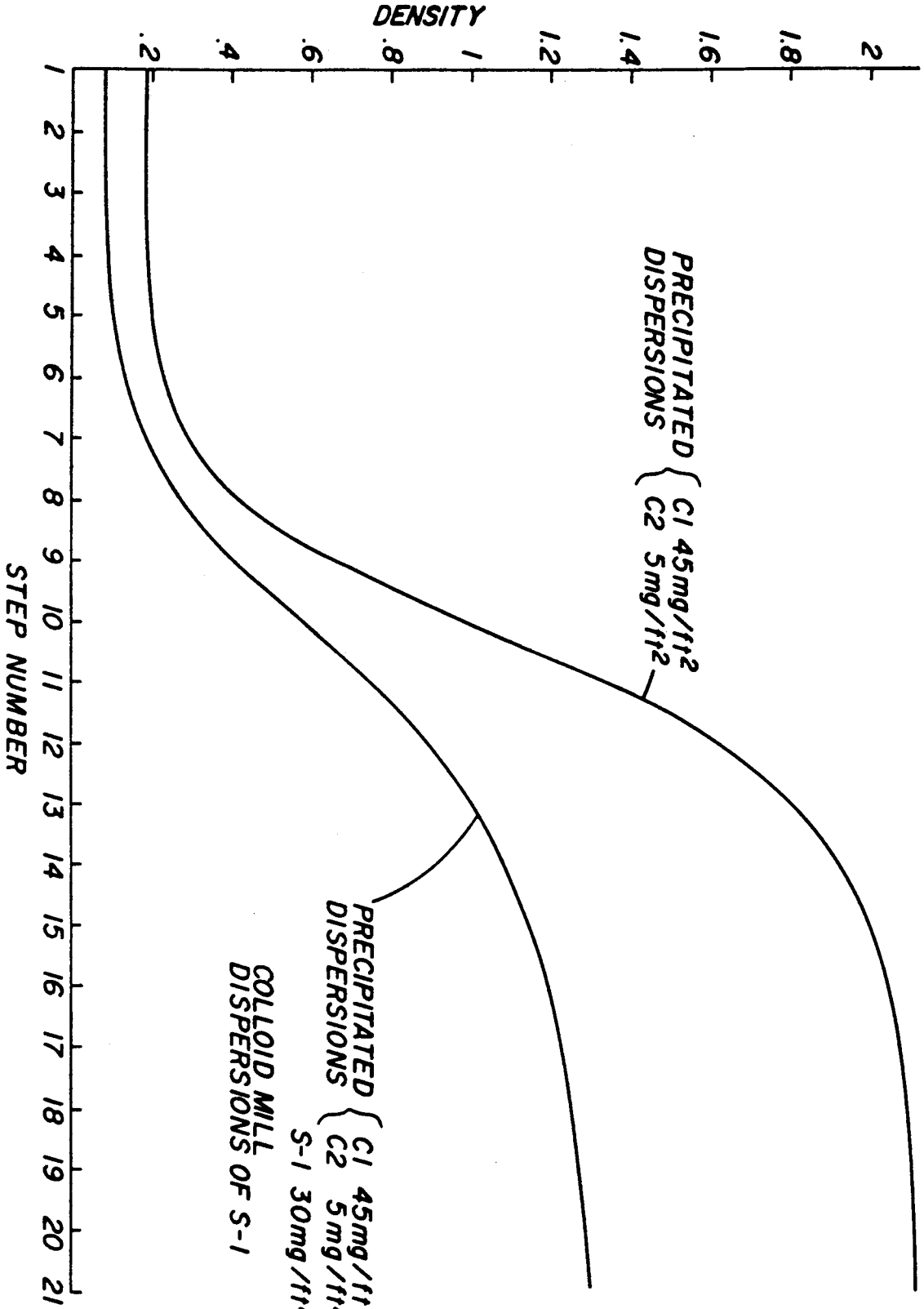

The above dispersion of S-1 was coated with precipitated dispersions of C1 and C2 at the same laydowns as before, and the strips were exposed and processed in the same way. The results are shown in FIG. 4.

EXAMPLE 3

This Example illustrates the effect of permanent solvent on the light stability of the image dye obtained from a precipitated dispersion of the cyan coupler C3. The permanent solvent increases the dye stability.

PREPARATION OF THE PRECIPITATED DISPERSION

A precipitated dispersion of the cyan coupler C3 was prepared in the following manner: Four grams of the coupler was dissolved in a mixture of 10.6 ml of n-propanol and 8 ml of 4% sodium hydroxide solution. 200 ml of an aqueous solution containing 0.8 grams of sodium dodecyl sulfate and 2 grams of polyvinylpyrrolidone was added to the dissolved coupler with stirring. A 15% solution of acetic acid was then added to lower the pH of the composition to 6 and form a finely divided suspension of the coupler. The dispersion was washed with distilled water for two hours using dialysis membrane tubing. The washed dispersion contained 1.6% w/w C3. The dispersion remained stable even at room temperature for over two months.

PREPARATION OF SOLVENT DISPERSION (A)

A dispersion of di-butyl phthalate was prepared in the following manner: Eighty grams of di-butyl phthalate (S-2) was mixed with 40 grams of SA-1 and heated to 71° C. A mixture of 218 grams of a 12.5% gelatin solution, 54 grams of distilled water, and 27 grams of a 10% solution of A-12 was treated with 5.5 ml of 2N propionic acid and then added to the heated oil phase with stirring. The composition was passed five times through a colloid mill. The dispersion was chilled, noodled, and washed for four hours. The washed dispersion contained 14.2% w/w di-butyl phthalate.

PREPARATION OF SOLVENT DISPERSION (B)

A dispersion of p-dodecylphenol (S-3) was prepared in the following manner: Ninety grams of p-dodecylphenol was heated to 60° C. Thirty grams of a 10% A-12 aqueous solution was mixed with 240 grams of a 12.5% gelatin solution and 120 grams of distilled water and then heated to 45° C., then gelatin solution was added to the oil with stirring. The composition was passed three times through a colloid mill and then chill set. The final dispersion contained 16.8% p-dodecylphenol.

A portion of the precipitated dispersion was mixed with portions of the solvent dispersions A and B. The resulting composition was mixed with the emulsion and coated on a paper support. A UV light absorbing layer was coated above the emulsion layer. The laydowns of silver and coupler were 16 and 50 mg/sq ft respectively. The amounts and proportions of A and B were varied to obtain different levels of solvent in the coatings. The coatings were exposed to white light for 0.1 s through a 21 step 0.15 logE increment tablet and processed in standard RA-4 chemistry. The reflection density of the processed strips was measured before and after a two-week 50 Klux sunshine fading test. The results are reported in Table 1 below, as a percentage loss in dye density from an initial density of 1.0.

TABLE 1

| Coating composition | | | |
|---|---|---|---|
| C-3 mg/ft 2 | S-3 mg/ft$^2$ | S-2 mg/ft$^2$ | % Dye Fade |
| 50 | 0 | 0 | 71 |
| 50 | 25 | 0 | 42 |
| 50 | 8.25 | 16.75 | 27 |
| 50 | 50.0 | 0 | 19 |
| 50 | 16.5 | 33.5 | 10 |
| 50 | 0 | 50.0 | 8 |

EXAMPLE 4

This Example illustrates the effect of permanent solvent on the reactivity of a precipitated dispersion of the image coupler C3. The reactivity is shown to be increased.

A precipitated dispersion of C3 was prepared in the same manner as described in Example 3.

A dispersion containing the permanent solvent S-1 in the Latex A latex was prepared in the same manner as described in Example 1.

The dispersions were mixed with gelatin and coated on a cellulose acetate support along with a green sensitized iodobromide emulsion at laydowns of 45 mg/ft$^2$ C3, 45 mg/ft$^2$ S-1, 150 mg/ft$^2$ silver, and 250 mg/ft$^2$ gelatin. An overcoat containing hardener was coated above the emulsion layer. A second coating containing the same laydown of coupler, emulsion, and gelatin but no permanent solvent S-1 was formed as the control. The coatings were exposed and processed in the same manner as described in Example 1.

Figure 5:
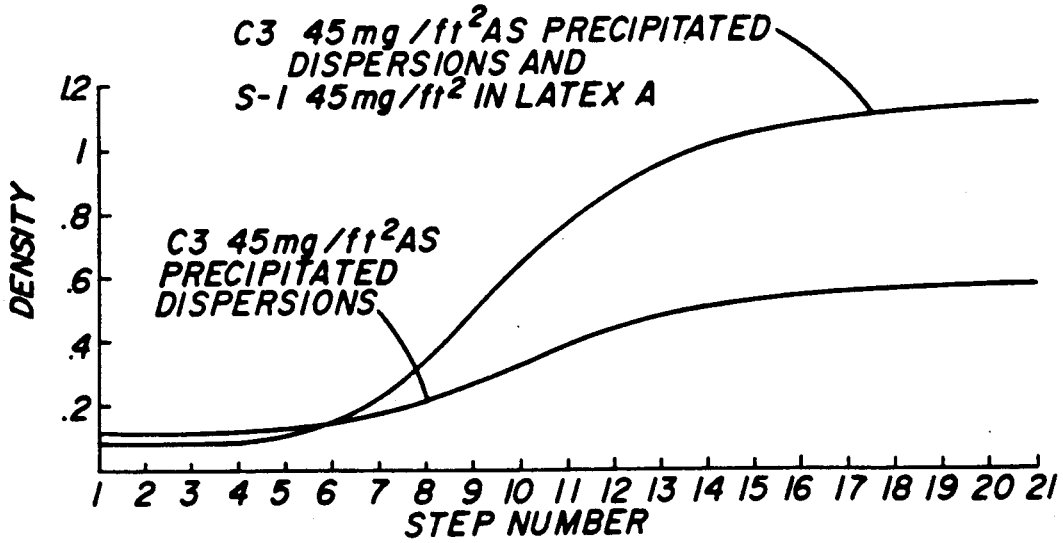

The results are shown in FIG. 5.

EXAMPLE 5

This Example illustrates the permanent coupler solvent acting to increase the light stability of the image dye obtained from a precipitated dispersion of the cyan coupler C4 and also the increased reactivity of the dispersion.

A precipitated dispersion of the cyan coupler C4 was prepared in the following manner: 30.0 grams of C4 was dissolved in mixture of 60.0 ml of n-propanol and 60.0 ml of 1M sodium hydroxide. A surfactant solution was prepared by dissolving 15 grams of polyvinylpyrrolidone (40000 mw) in 750 ml 0.02M sodium dodecyl sulfate in water. The surfactant solution was added to the dissolved coupler with stirring. A 15% solution of acetic acid was then added to lower the pH of the composition to 6 and form a dispersion of the coupler. The dispersion was poured into a dialysis bag and washed with distilled water for four hours. The coupler content in the washed dispersion was 2.8%.

A dispersion of the permanent solvent S-2 was prepared in the same manner as described in Example 3 (dispersion A).

The precipitated dispersion was mixed with the dispersion of the permanent solvent. The resulting composition was mixed with gelatin and coated on a paper support. A UV light absorbing layer was coated above the emulsion layer. The laydowns of silver, coupler, and the permanent solvent S-2 were 18, 39.3, and 19.6 mg/ft$^2$ respectively. A second coating was made containing the same laydowns of silver and coupler but with no coupler solvent. This was used as the control. The coatings were exposed to white light for 0.1 s through a 21-step 0.15 logE increment tablet and processed in standard RA-4 chemistry. The reflection density of the processed strips was measured before and after a two-week and four-week 50 Klux sunshine fade test. The results are reported as a percentage loss in dye density from an initial density of 1.0 and illustrate the decreased fade of the solvent containing materials of the invention.

| | % Dye Fade | |
|---|---|---|
| | 2-Week 50 Klux Fade | 4-Week 50 Klux Fade |
| Control | 37 | 75 |
| Invention | 12 | 26 |

The fresh sensitometry from the invention coating had a contrast of 2.42, whereas the fresh sensitometry from the control coating had a contrast of 1.94 illustrating the increased reactivity of the invention materials.

EXAMPLE 6

This Example and Example 7 illustrate the influence of permanent solvent on the reactivity of a precipitated dispersion of the coupler C9. The permanent solvent is shown to cause an increase in reactivity.

A precipitated dispersion of C9 was prepared using the following procedure: 4.0 grams of the compound was mixed with 10.0 grams of n-propanol and heated to 60° C. 1.3 grams of a 20% w/w solution of sodium hydroxide was then added, and the mixture was stirred until the coupler dissolved completely. A surfactant solution containing 3.8 grams of 30% w/w A-14 in 100 grams of water was then added to the dissolved coupler at room temperature. A 15% w/w solution of acetic acid was added to lower the pH to 6. The dispersion was washed for four hours using a dialysis membrane tubing.

A dispersion containing the permanent solvent S-1 in the Latex A latex was prepared in the same manner as described in Example 1.

Figure 6:
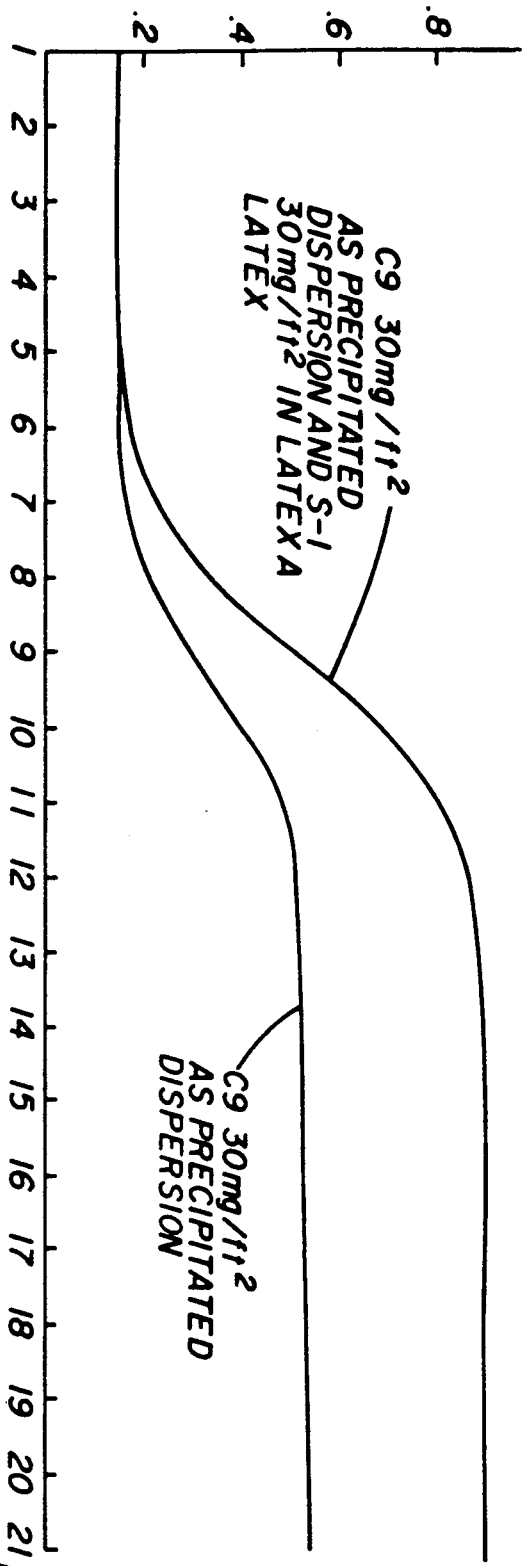

The dispersions were mixed with gelatin and coated on a cellulose acetate support along with a green sensitized iodobromide emulsion at laydowns of 30 mg/ft$^2$ C9, 30 mg/ft$^2$ S-1, 150 mg/ft$^2$ silver, and 250 mg/ft$^2$ gelatin. An overcoat containing hardener was coated on top of the emulsion layer. A second coating containing the same laydown of coupler, emulsion, and gelatin, but no permanent solvent S-1, was formed as the control. The coatings were exposed and processed in the same manner as described in Example 1 except that the time of contact with the color developer solution was one minute and fifteen seconds. The results are shown in FIG. 6.

EXAMPLE 7

(Control)

The procedure of Example 6 is repeated except that the dispersion of S-1 was prepared using a colloid mill instead of using a polymer latex as described in Example 2.

Figure 7:
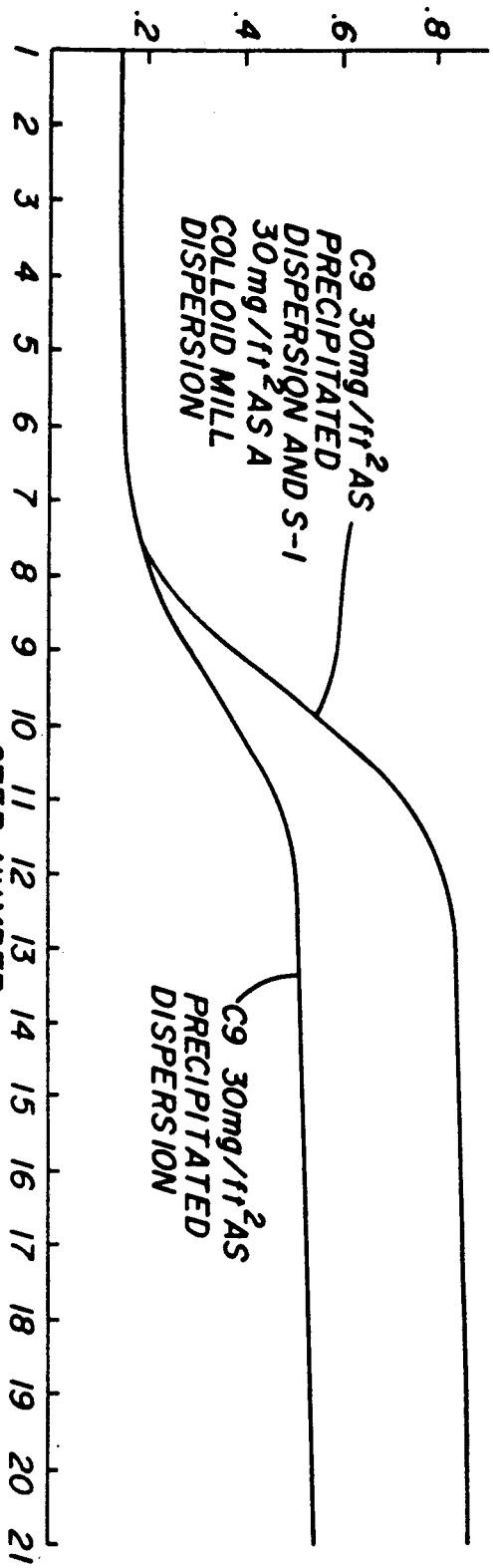

The dispersion of S-1 was coated with a precipitated dispersion of C9 at the same laydown as in Example 6, and the strips were exposed and processed in the same way. The results are shown in FIG. 7.

The invention has been described in detail with particular reference to preferred embodiments thereof, but it will be understood that variations and modifications can be effected within the spirit and scope of the invention.

We claim:

1. A method of forming photographic dispersions comprising providing an aqueous dispersion of photographic coupler:

providing an aqueous dispersion of activating permanent solvent;

combining said dispersion of photographic coupler and said dispersion of permanent solvent to form a combined dispersion; and mixing said combined dispersion with silver halide emulsion wherein said dispersion of photographic coupler is prepared without using a colloid mill or homogenizer.

2. The method of claim 1 wherein said dispersion of photographic coupler is provided by precipitation from an auxiliary solvent solution by pH or solvent shift.

3. The method of claim 1 wherein said activating permanent solvent is incorporated in a latex.

4. The method of claim 3 wherein the said latex comprises at least one member selected from the group consisting essentially of acrylic acid-alkylacrylate copolymers, methacrylic acid-alkylacrylate copolymers, acrylic acid-alkylmethacrylate copolymers, and methacrylic acid-alkylmethacrylate copolymers.

5. The method of claim 1 wherein said dispersion of photographic coupler further comprises a surfactant.

6. The method of claim 1 wherein said dispersion of photographic coupler further comprises a surfactant containing 8 to 20 carbons in the hydrocarbon chain and a sulfate or sulfonate moiety.

7. The method of claim 3 wherein said combined dispersion comprises particles comprised of a mixture of latex, permanent solvent, and coupler.

8. The method of claim 1 wherein said photographic dispersion of claim 1 forms a photographic element having improved dye stability.

9. The method of claim 1 wherein said coupler comprises at least one of

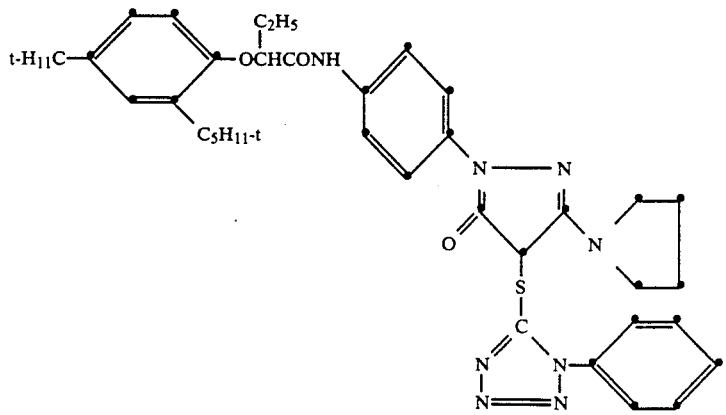

-continued
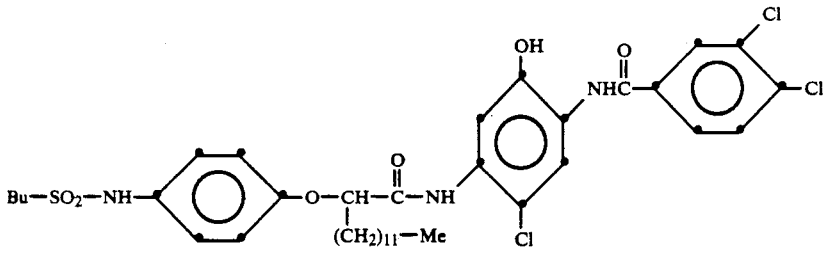
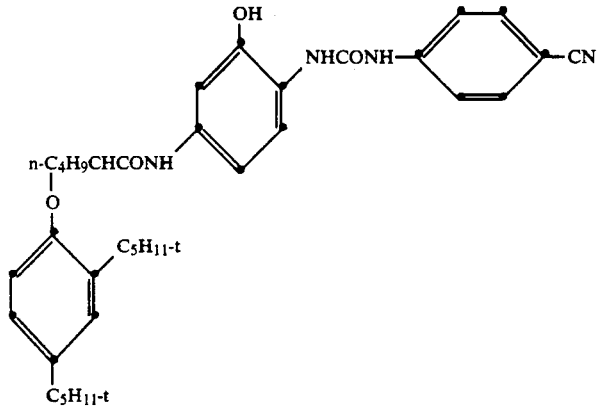
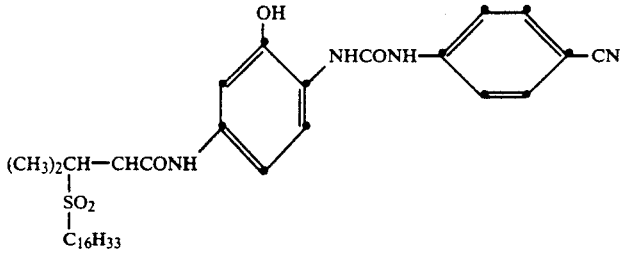
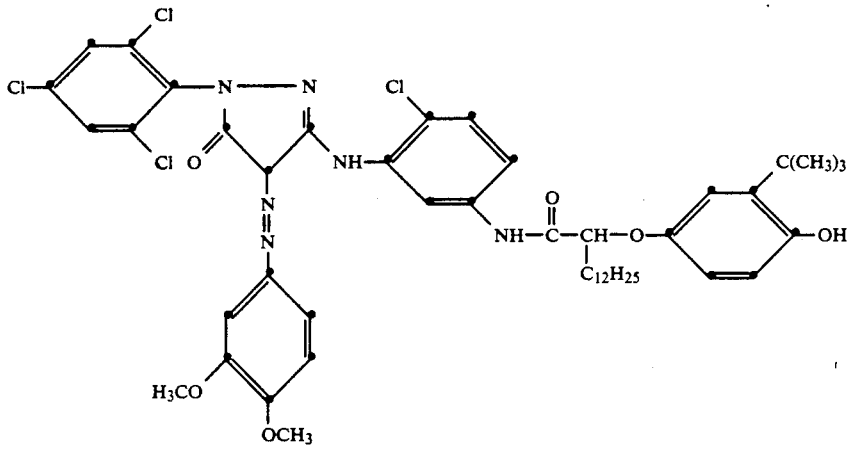

-continued

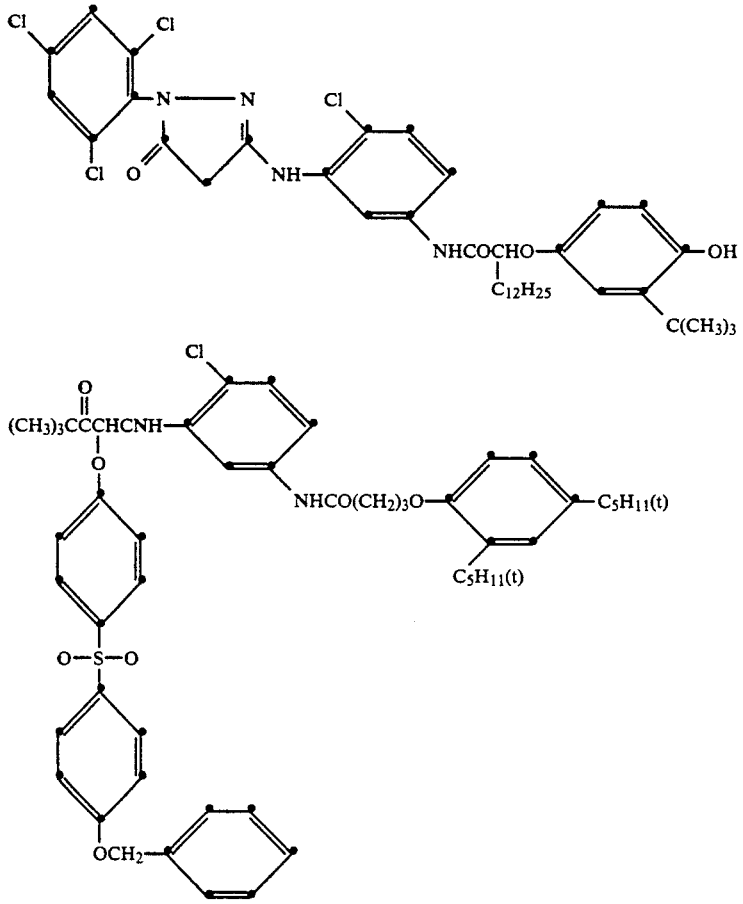

10. The method of claim 1 wherein said permanent solvent comprises at least one of tri-cresyl phosphate, di-n-butyl phthalate, and p-dodecylphenol.

11. The method of claim 1 wherein said dispersion of permanent solvent and said dispersion of photographic coupler are combined immediately prior to coating.

12. The method of claim 1 wherein said dispersion of photographic coupler may be stored at room temperature for at least one month without significant particle size growth.

13. The method of claim 1 wherein said dispersion of activating permanent solvent is prepared without using a colloid mill or homogenizer.

14. The method of claim 3 wherein said latex is a copolymer of ethylacrylate, acrylic acid, and 2-acrylamido-2-methyl propane sulfonic acid sodium salt in the ration 75:20:5 by weight.

15. The method of claim 7 wherein said surfactant is selected from the group consisting of at least one of sodium dodecyl sulfate, a mixture of di-isopropyl and tri-isopropyl naphthalene sodium sulfate,

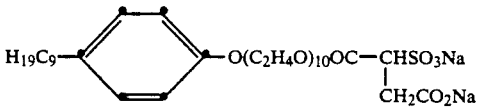

A-13

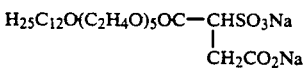

A-14 and

-continued

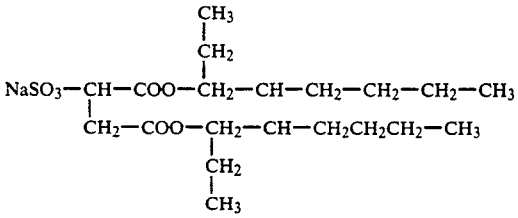

A-15

16. The method of claim 1 wherein said dispersion of activating permanent solvent further comprises gelatin.

17. A method of forming photographic element having improved dye stability comprising providing an aqueous dispersion of photographic coupler;

providing an aqueous dispersion of activating permanent solvent incorporated in a latex;

combining said dispersion of photographic coupler and said dispersion of permanent solvent to form a combined dispersion;

mixing said combined dispersion with silver halide emulsion; and coating the mixture of said combined dispersion and said silver halide emulsion on a substrate.

18. The method of claim 17 wherein said dispersion of photographic coupler is provided by precipitation from an auxiliary solvent solution by pH or solvent shift.

19. The method of claim 17 wherein the said latex comprises at least one member selected from the group consisting essentially of acrylic acid-alkyl-acrylate copolymers, methacrylic acid-alkylacrylate copolymers, acrylic acid-alkylmethacrylate copolymers, and methacrylic acid-alkylmethacrylate copolymers.

20. The method of claim 17 wherein said dispersion of photographic coupler further comprises a surfactant.

21. The method of claim 17 wherein said dispersion of photographic coupler further comprises a surfactant comprising at least one of a mixture of di-isopropyl and tri-isopropyl naphthalene sodium sulfonate and

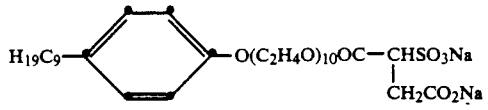

22. The method of claim 17 wherein said coupler comprises at least one of

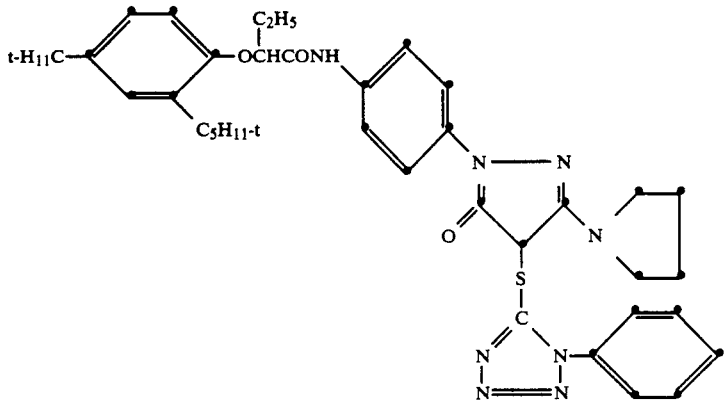

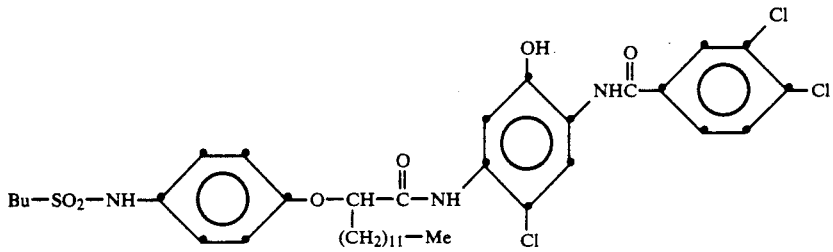

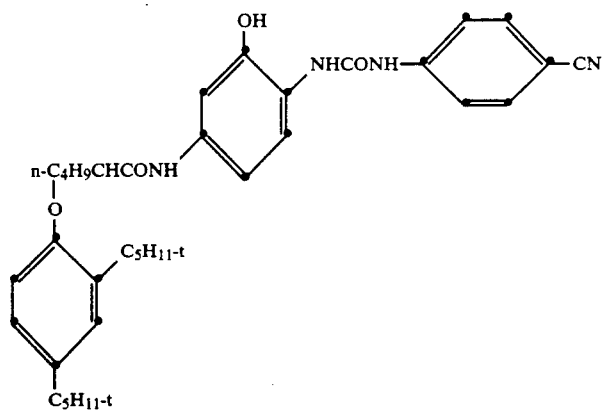

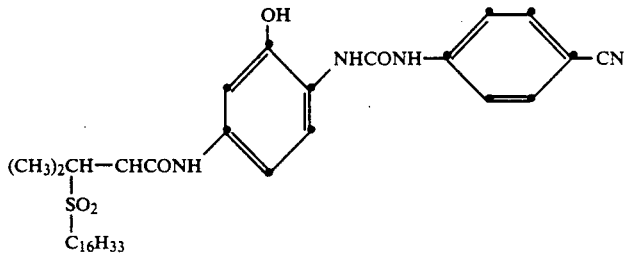

-continued

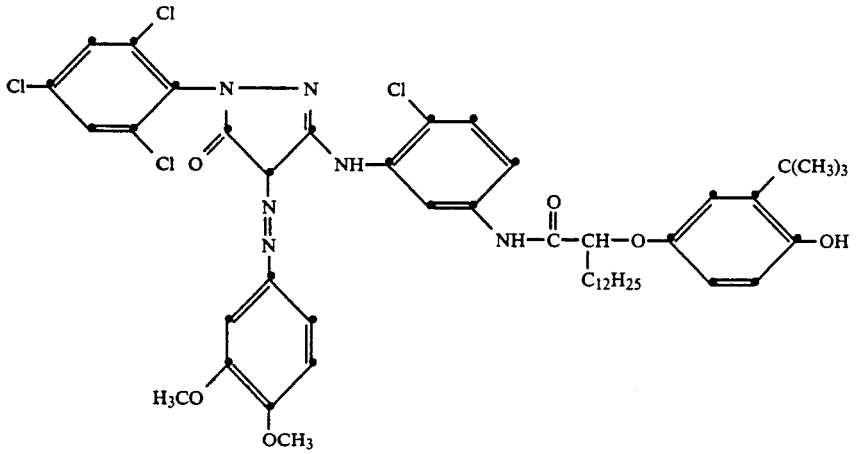

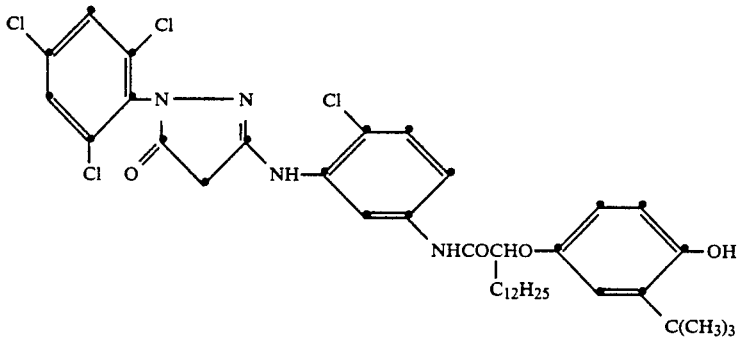

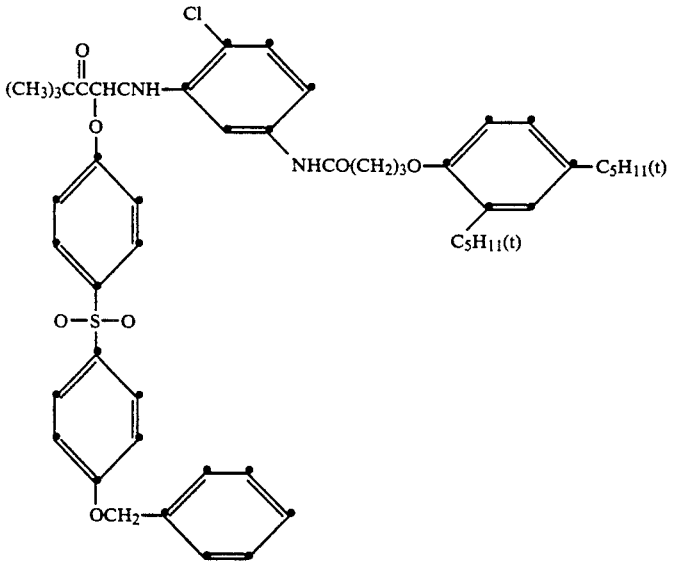

23. The method of claim 17 wherein said permanent solvent comprises at least one of tri-cresyl phosphate, di-n-butyl phthalate, and p-dodecylphenol.

24. The method of claim 17 wherein said dispersion of permanent solvent and said dispersion of photographic coupler are combined immediately prior to coating.

25. The method of claim 17 wherein said latex is a copolymer of ethylacrylate, acrylic acid, and 2-acrylamido-2-methyl propane sulfonic acid sodium salt in the ratio 75:20:5 by weigth.

26. A method of forming photographic element having improved dye stability comprising providing an aqueous dispersion of photographic coupler;

providing an aqueous dispersion of activating permanent solvent;

combining said dispersion of photographic coupler and said dispersion of permanent solvent to form a combined dispersion;

mixing said combined dispersion with silver halide emulsion; and coating the mixture of said combined dispersion and said silver halide emulsion on a substrate, wherein said dispersion of photographic coupler is prepared without using a colloid mill or homogenizer.

27. The method of claim 26 wherein said dispersion of photographic coupler is provided by precipitation from an auxiliary solvent solution by pH or solvent shift.

28. The method of claim 26 wherein said activating permanent solvent is incorporated in a latex.

29. The method of claim 28 wherein the said latex comprises at least one member selected from the group consisting essentially of acrylic acid-alkylacrylate copolymers, methacrylic acid-alkylacrylate copolymers, acrylic acid-alkylmethacrylate copolymers, and methacrylic acid-alkylmethacrylate copolymers.

30. The method of claim 26 wherein said dispersion of photographic coupler further comprises a surfactant comprising at least one or a mixture of di-isopropyl and tri-isopropyl naphthalene sodium sulfonate and

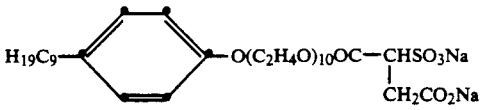

31. The method of claim 26 wherein said coupler comprises at least one of

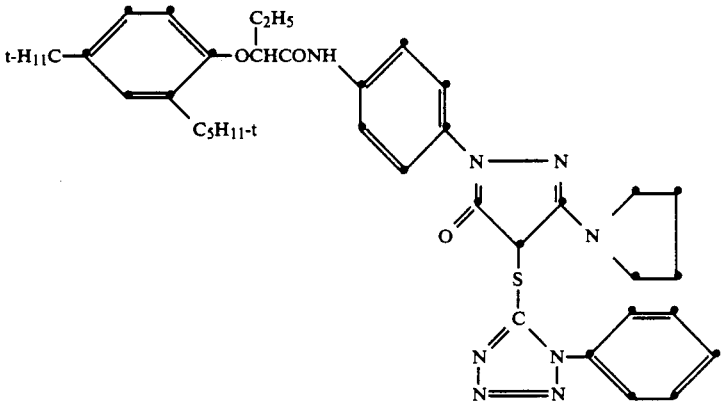

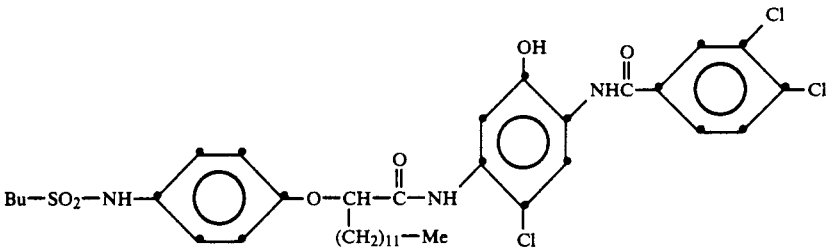

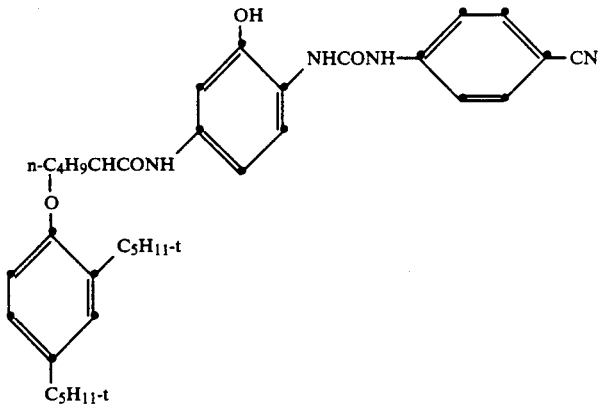

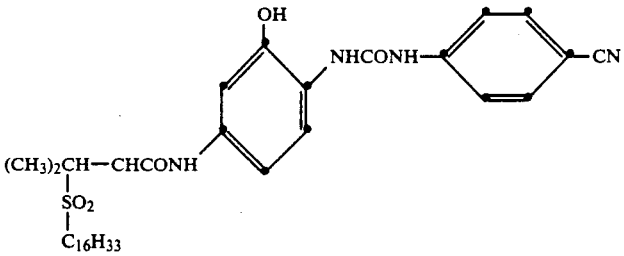

-continued
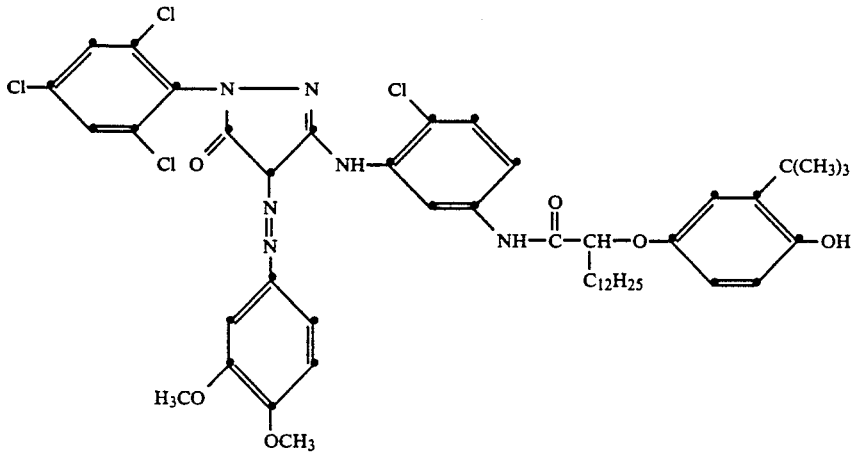
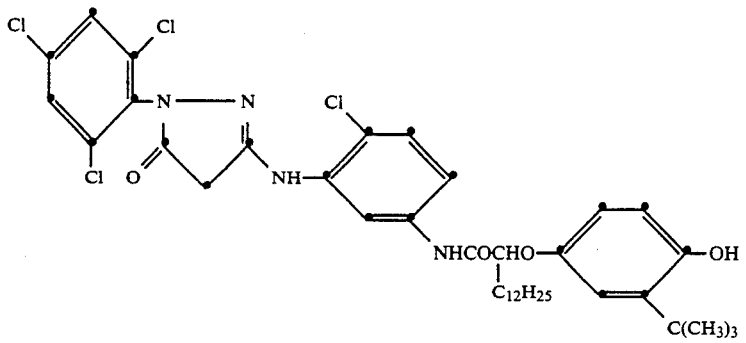
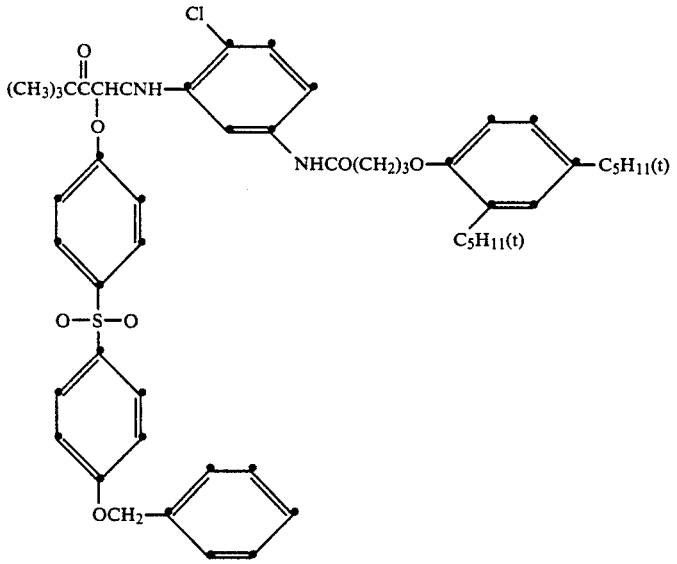
* * * * *